US006454574B1

(12) United States Patent
Yu

(10) Patent No.: US 6,454,574 B1
(45) Date of Patent: Sep. 24, 2002

(54) ELECTRICAL CARD CONNECTOR

(75) Inventor: Hung-Chi Yu, Hsi-Chih (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/803,483

(22) Filed: Mar. 8, 2001

(30) Foreign Application Priority Data

Dec. 21, 2000 (TW) ..... 89222260 U

(51) Int. Cl.[7] ..... H01R 9/09
(52) U.S. Cl. ..... 439/79; 439/637
(58) Field of Search ..... 439/79, 630–637, 439/325–328

(56) References Cited

U.S. PATENT DOCUMENTS 4,780,095 A * 10/1988 Classon et al. ..... 439/630
5,203,725 A * 4/1993 Brunker et al. ..... 439/636
5,259,793 A * 11/1993 Yamaha et al. ..... 439/637
5,514,002 A * 5/1996 Cheng et al. ..... 439/637
5,951,335 A * 9/1999 Kurotori et al. ..... 439/79
6,099,328 A * 8/2000 Nelson et al. ..... 439/637

* cited by examiner

*Primary Examiner*—Hien Vu
(74) *Attorney, Agent, or Firm*—Wei Te Chung

(57) ABSTRACT

A PCMCIA card connector (1) includes a dielectric housing (20) and a number of first and second terminals (31, 32) received in the dielectric housing. The dielectric housing comprises a pair of parallel arms (200) and a main body (201) between the arms. The main body comprises a front mating face (25) and a bottom face (26). Each of the terminals defines a horizontal contact portion (31*a*, 32*a*), a solder portion (31*b*, 32*b*) and a vertical mounting portion (31*c*, 32*c*). The solder portion extends downwardly from the contact portion for soldering to a printed circuit board. The mounting portion of the first terminal extends downwardly from the contact portion and the mounting portion of the second terminal extends upwardly from the contact portion. The mounting portions are received in mounting holes (22, 24) of the dielectric housing from a top and a bottom sides of the dielectric housing.

4 Claims, 4 Drawing Sheets

ELECTRICAL CARD CONNECTOR

BACKGROUND OF THE INVENTION

1. Field of the Invention

The present invention relates to an electrical card connector, and particularly to an electrical card connector which has a reduced front-to-rear length.

2. Description of Related Art

As the popularity of notebook computers increases, integrated circuit (IC) cards are becoming more common for increasing storage capacity or interfacing the notebook computers with other devices. Card connectors are commonly used to connect mother boards of the computer with the cards. Most current IC cards and card connectors conform to the standards of Personal Computer Memory Card International Association (PCMCIA).

Conventional PCMCIA card connectors are disclosed in U.S. Pat. No. 5,601,438 and Taiwan Patent Application Nos. 84206174 and 84206175. Referring to FIG. 4, a conventional PCMCIA card connector 7 comprises a dielectric housing 71 and a plurality of terminals 72, 73. The dielectric housing 71 defines a plurality of receiving passageways 711, 712 extending through the housing 71 from a front face 713 to a rear face 714 thereof in upper and lower rows. Each terminal 72 (73) comprises a contact portion 72*b* (73*b*) at one end thereof, a solder portion 72*c* (73*c*) at the other end thereof, and a fixing portion 72*a* (73*a*) between the contact portion 72*b* (73*b*) and the solder portion 72*c* (72*c*). The terminals 72, 73 are assembled in corresponding receiving passageways 711, 712 of the housing 71 with the contact portions 72*b*, 73*b* extending beyond the front face 713, the fixing portions 72*a*, 73*a* secured in the receiving passageways 711, 712, and the solder portions 72*c*, 73*c* soldered to a printed circuit board 8. Because the solder portions 72*c*, 73*c* of the terminals 72, 73 are all located at a rear side of the housing 71 and in particular the solder portions 72*c* are located farther from the rear face 714 of the housing 71 than the solder portions 73*c*, the whole length of the PCMCIA card connector 7 is increased, thereby occupying increased space on the printed circuit board 8.

Hence, an improved PCMCIA card connector is required to overcome the disadvantages of the conventional electrical card connector.

SUMMARY OF THE INVENTION

Accordingly, a main object of the present invention is to provide a PCMCIA card connector having a reduced length thereby occupying less space on a printed circuit board.

In order to achieve the object set forth, a PCMCIA card connector in accordance with the present invention includes a dielectric housing and a plurality of first and second terminals received in the dielectric housing. The dielectric housing includes a pair of parallel arms and a main body between the arms. The main body comprises a frontmating face, a rear face opposite to the front mating face, a bottom face, and an upper face opposite to the bottom face. The main body defines a plurality of vertical mounting holes on the upper face and bottom face. The first and second terminals are inserted into the main body from upper and lower faces thereof, respectively. Each terminal defines a horizontal contact portion, a solder portion and a vertical mounting portion. The contact portion extends beyond the mating face for mating with the electrical card. The solder portion of the first terminal extends downwardly from rear end of the contact portion and a horizontal portion thereof extends rearwardly beyond the rear face of the housing. The solder portion of the second terminal extends from a middle of the contact portion and a horizontal portion thereof extends forwardly beyond the mating face. The mounting portion of the first terminal extends downwardly from a middle of the contact portion of the first terminal. The mounting portion of the second terminal extends upwardly from a rear end of the contact portion of the second terminal. The mounting portions are received in the vertical mounting holes thereby securing the terminals to the dielectric housing Other objects, advantages and novel features of the invention will become more apparent from the following detail description when taken in conjunction with the accompanying drawings.

DETAILED DESCRIPTION OF THE INVENTION

Figure 1:
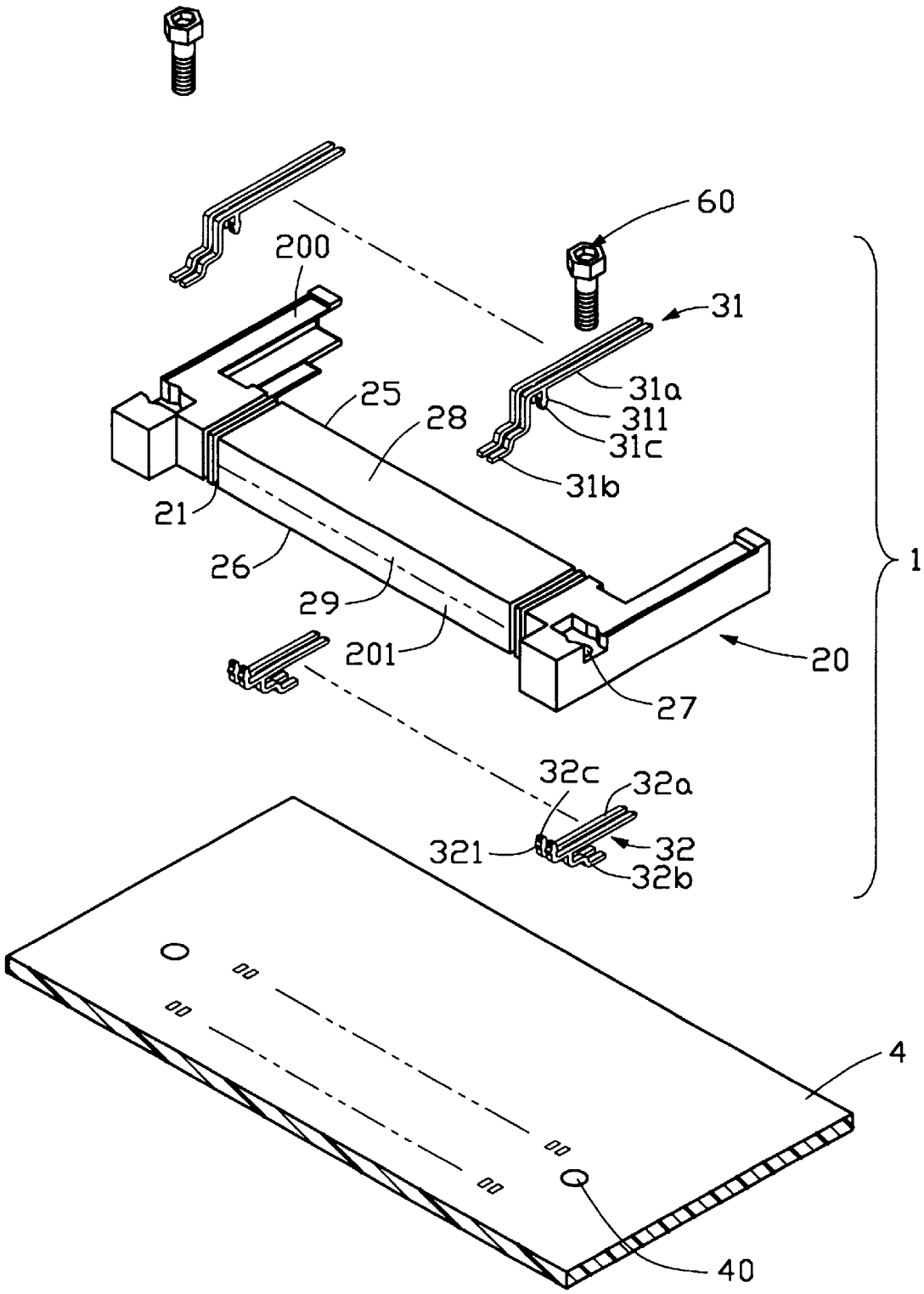
FIG. 1 is an exploded, perspective view of a PCMCIA card connector in accordance with the present invention and a printed circuit board.

Reference will now be made to the drawing FIGS. to describe the present invention in detail.

Figure 2:
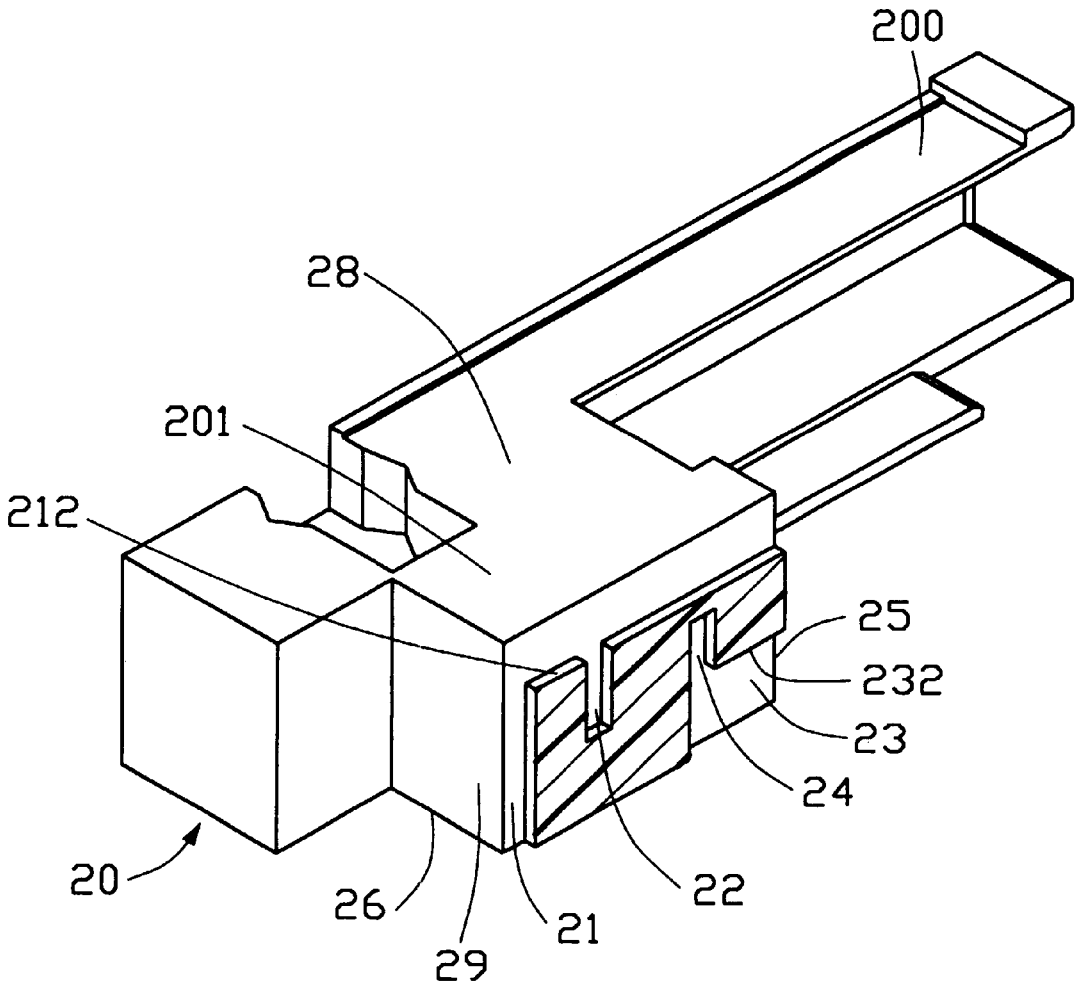
FIG. 2 is a partial, cross-sectional view of a dielectric housing of the PCMCIA card connector of FIG. 1.

Referring to FIG. 1 and FIG. 2, a PCMCIA card connector 1 in accordance with the present invention includes a dielectric housing 20, a plurality of first terminals 31 and second terminals 32, and a pair of fasteners such as screws 60.

The dielectric housing 20 comprises a pair of parallel arms 200 and a main body 201 between the arms 200. The main body 201 comprises a front mating face 25, a rear face 29 opposite to the front mating face 25, a bottom face 26, and an upper face 28 opposite to the bottom face 26. The main body 201 defines a plurality of L-shaped first receiving channels 21 exposed to the upper face 28 and the rear face 29 thereof, and a plurality of horizontal second receiving channels 23 in the bottom face 26 thereof. Each of the first and second receiving channels 21, 23 respectively has a first and second bottom face 212, 232. The main body 201 further defines an upper vertical mounting hole 22 in the first bottom face 212 to communicate with the first receiving channel 21, and a lower vertical mounting hole 24 in the second bottom face 232 to communicate with the horizontal second receiving channel 23. Each upper vertical mounting hole 22 aligns with each lower vertical mounting hole 24 along the direction that the arms 200 extend. The arms 200 each defines a retention hole 27 near the main body 201 for extension of the screw 60 to fix the connector 1 to the printed circuit board 4.

The first and second terminals 31, 32 respectively comprise horizontal contact portions 31*a*, 32*a*. A solder portion 31*b* extends downwardly and rearwardly from a rear end of the contact portion 31*a* of the first terminal 31 and a solder portion 32*b* extends downwardly and forwardly from a middle portion of the contact portion 32*a* of the second terminal 32. Each first terminal 31 comprises a mounting portion 31*c* extending downwardly and vertically from a middle portion of the contact portion 31*a*. Each second terminal 32 includes a mounting portion 32*c* extending upwardly and vertically from a rear end of the contact portion 32*a*. The mounting portions 31*c*, 32*c* form protrusions 311, 321 for biting the housing 20.

Figure 3:
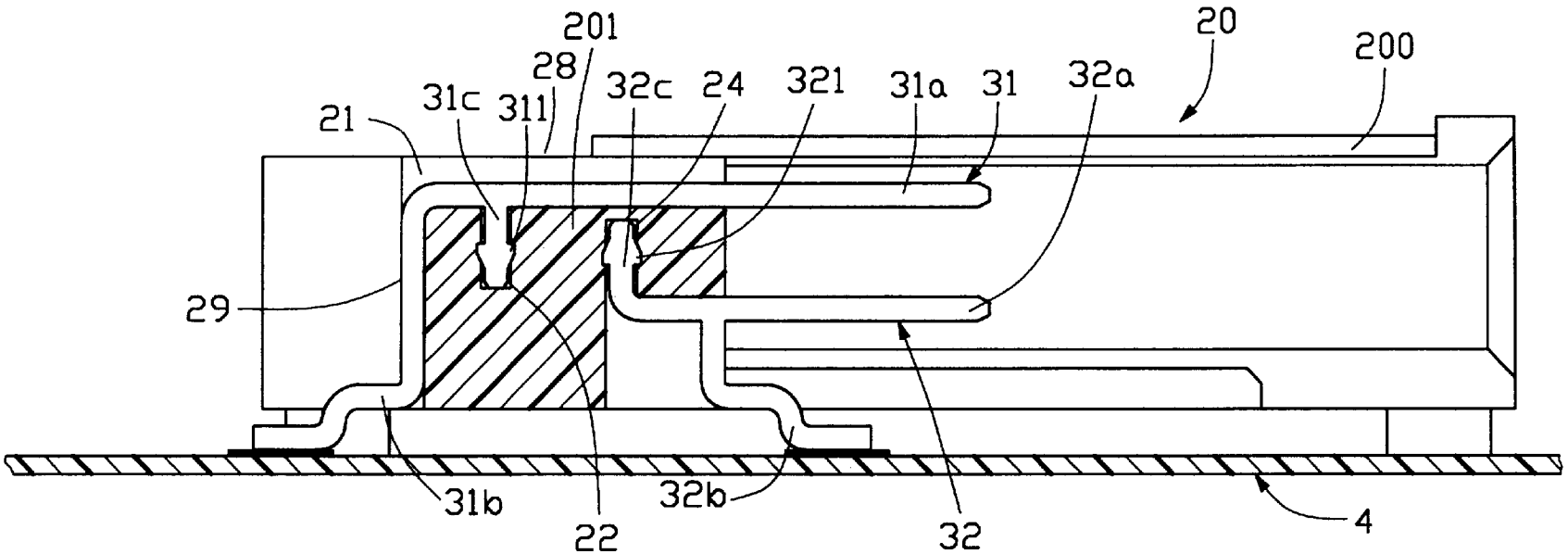
FIG. 3 is a cross-sectional view of the PCMCIA card connector mounted on the printed circuit board.
Figure 4:
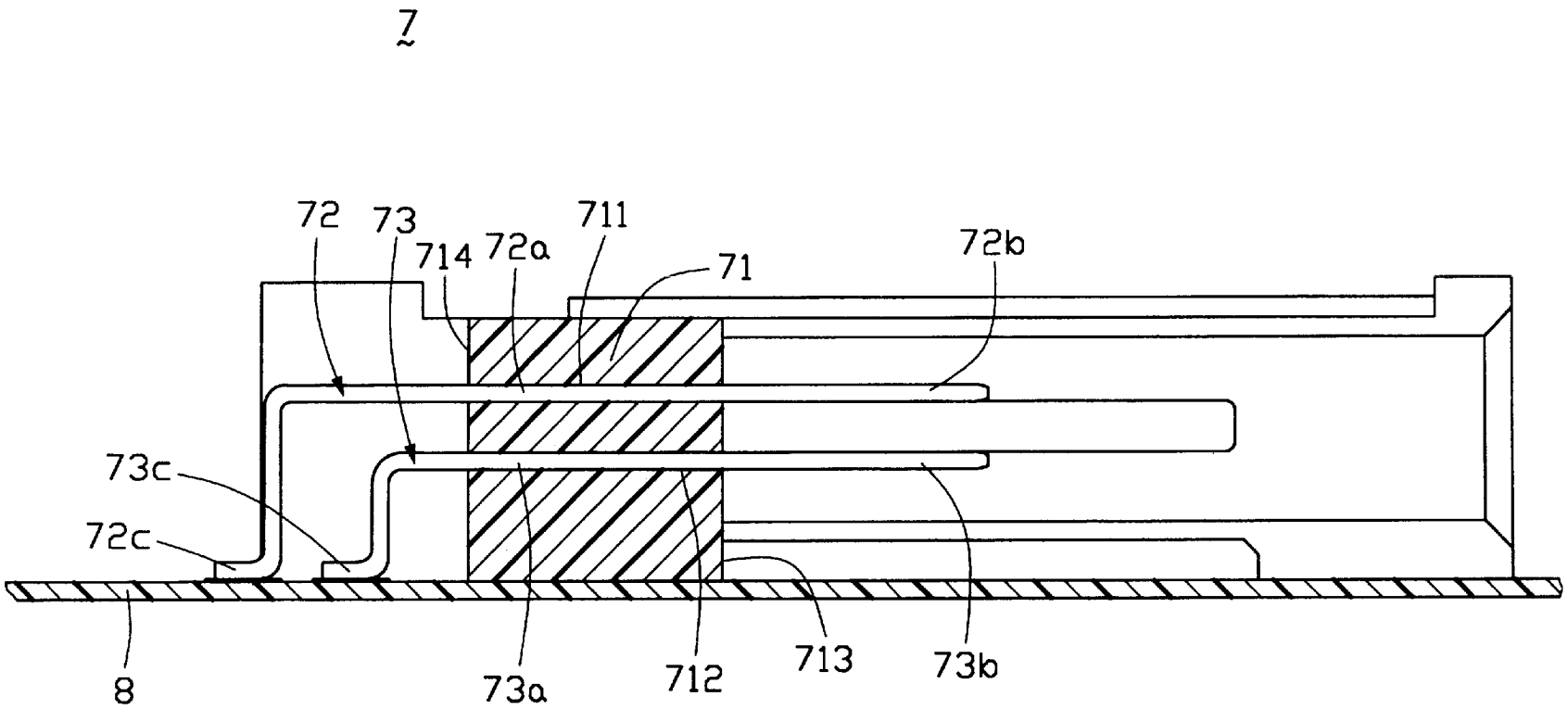
FIG. 4 (PRIOR ART)
FIG. 4 is a cross-sectional view of a conventional PCMCIA card connector which is mounted on the printed circuit board.

Referring to FIG. 2 and FIG. 3, in assembly, the first terminals 31 are inserted into the main body 201 from an upper side thereof to a position wherein the mounting portions 31*c* are received in the mounting holes 22in which the protrusions 311 bite into the housing 20 to secure the first terminals 31 to the housing 20, and the contact portions 31*a* are received in a horizontal section of the first receiving channels 21 with a mating portion thereof protruding forwardly beyond the mating face 25 of the main body 201 for mating with an inserted electrical card (not shown). A vertical section of each solder portion 31*b* is fitted in a vertical section of the corresponding first receiving channel 21 while a lower horizontal section of the solder portion 31*b* horizontally and rearwardly extends from a lower end of the vertical section of the solder portion 31*b*. The second terminals 32 are inserted into the main body 201 from a lower side thereof to a position where the mounting portions 32*c* are received in the mounting holes 24 with the protrusions 321 biting into the housing 20 thereby securing the second terminals 32 to the housing 20. The contact portions 32*a* are received in the corresponding second receiving channels 23 with a mating portion thereof protruding forwardly beyond the mating face 25 of the main body 201 for mating with the electrical card. A vertical section of each solder portion 32*b* is fitted in a corresponding second receiving channel 23 while a lower horizontal section of the solder portion 32*b* horizontally and forwardly extends from a lower end of the vertical section of the solder portion 32*b*. The screws 60 extend through the retention holes 27 of the housing 20 and through holes 40 of the printed circuit board 4 to mount the housing 20 on the printed circuit board 4. Finally, the horizontal sections of the solder portions 31*b*, 32*b* are soldered to the printed circuit board 4.

The terminals 31, 32 are inserted into the main body 201 from two opposite sides and the solder portions 31*b*, 32*b* are located on different sides of the main body 201. Therefore, the length of the PCMCIA card connector 1 can be reduced, thereby occupying less area on the printed circuit board 4. In addition, the mounting portions 31*c*, 32*c* are vertically inserted into the mounting holes 22, 24, while the force of he terminals 31, 32 being subjected to is horizontal, so the terminals 31, 32 can not be pushed or pulled out of the main body 201 during mating with the electrical card. Therefore, the terminals 31, 32 are securely mounted to the dielectric housing 20.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended clams are expressed.

What is claimed is:

1. An electrical card connector adapted for interconnecting an electrical card with a printed circuit board, comprising:

a dielectric housing comprising a front mating face and a plurality of upper and lower vertical mounting holes;

a plurality of first terminals each having a horizontal contact portion extending forwardly beyond the mating face for engaging with an electrical card and a first vertical mounting portion extending downwardly from the horizontal contact portion, the first vertical mounting portion being secured in the upper vertical mounting hole of the dielectric housing; and a plurality of second terminals each having a horizontal contact portion extending forwardly beyond the mating face and being parallel to the horizontal contact portion of the first terminal for engaging with the electrical card and a second vertical mounting portion extending upwardly from the horizontal contact portion thereof, the second vertical mounting portion being secured in the lower mounting hole of the dielectric housing; wherein the first and the second terminals each comprise a solder portion extending downwardly from the contact portion for soldering to a printed circuit board; wherein the dielectric housing defines a rear face opposite to the front mating face, a bottom face facing the printed circuit board, and a receiving channel in the rear face, and the solder portion of the first terminal comprises a vertical portion engaged with the channel; wherein the dielectric housing defines a bottom face facing the printed circuit board, and a receiving channel in the bottom face, and a section of the solder portion of the second terminal engages with the channel.

2. The electrical card connector in accordance with claim 1, wherein the dielectric housing comprises a main body and a pair of parallel arms at respective opposite ends of the main body.

3. The electrical card connector in accordance with claim 1, wherein each of the vertical mounting portions of the first and the second terminals forms a protrusion for interference fitting in a corresponding mounting hole.

4. An electrical header connector adapted for interconnecting an electrical card with a printed circuit board, comprising:

a dielectric housing comprising a front mating face, a rear face opposite to the front mating face, a bottom face facing a printed circuit board, and a plurality of upper and lower mounting holes perpendicular to the bottom face;

a plurality of first terminals, each first terminal having a horizontal contact portion, a solder portion and a mounting portion, the contact portion extending forwardly beyond the mating face for mating with an electrical card, the solder portion extending out of the bottom face for being soldered to the printed circuit board, the mounting portion extending perpendicularly and downwardly from the horizontal contact portion and being received in the upper mounting hole for securing to the dielectric housing; and a plurality of second terminals, each second terminal having a horizontal contact portion, a solder portion and a mounting portion, the contact portion extending forwardly beyond the mating face and being parallel to the horizontal contact portion of the corresponding first terminal for mating with the electrical card, the solder portion extending out of the bottom face for being soldered to the printed circuit board, the mounting portion extending perpendicularly and upwardly from the horizontal contact portion thereof and being received in the lower mounting hole for securing to the dielectric housing; wherein the dielectric housing defines a receiving channel in the rear face, and the solder portion of the first terminal comprises a vertical portion engaged with the receiving channel; wherein the dielectric housing defines a receiving channel in the bottom face, and a section of the solder portion of the second terminal engages with the receiving channel in the bottom face.

* * * * *